US005458078A

United States Patent [19]

Perette

[11] Patent Number: 5,458,078

[45] Date of Patent: Oct. 17, 1995

[54] HIGH SPEED CATAMARAN HULL AND BOAT

[76] Inventor: Robert J. Perette, 1183 Nantasket Ave., Unit H5, Hull, Mass. 02045

[21] Appl. No.: 267,662

[22] Filed: Jun. 29, 1994

[51] Int. Cl.[6] ..... B63B 1/20

[52] U.S. Cl. ..... 114/288; 114/273

[58] Field of Search ..... 114/288, 271, 114/273, 290, 61; D12/310

[56] References Cited

U.S. PATENT DOCUMENTS

| | | | |
|---|---|---|---|
| D. 290,948 | 7/1987 | Hledin | D12/310 |
| 1,712,281 | 5/1929 | Royer . | |
| 2,296,977 | 9/1942 | Brien . | |
| 2,666,406 | 1/1954 | Babcock | 114/61 |
| 3,126,856 | 3/1964 | Fuller . | |
| 3,177,836 | 4/1965 | Salamin | 114/61 |
| 3,470,839 | 10/1969 | Faul et al. | 114/61 |
| 3,625,173 | 12/1971 | Mitton | 114/61 |
| 3,776,168 | 12/1973 | Weeks | 114/290 |
| 3,937,164 | 2/1976 | Austin | 114/288 |
| 3,967,571 | 7/1976 | Mut | 114/61 |
| 3,996,869 | 12/1976 | Hadley | 114/56 |
| 4,091,761 | 5/1978 | Fehn | 114/290 |
| 4,478,166 | 10/1984 | Sorensen | 114/61 |
| 4,574,724 | 3/1986 | Stolper | 114/271 |
| 4,603,650 | 8/1986 | Bjorn | 114/288 |
| 4,924,792 | 5/1990 | Sapp et al. | 114/61 |

*Primary Examiner*—Sherman Basinger
*Attorney, Agent, or Firm*—Richard P. Crowley

[57] ABSTRACT

A high speed, high efficiency, stable catamaran boat hull which comprises a boat hull structure having an under surface, a curved bow and a generally flat stern, a pair of spaced-apart sponsons on either side of the keel line of the hull and extending generally substantially from the bow of the hull, wherein the sponsons generally come to a point, to the stern of the hull. The sponsons generally have vertical, downwardly extending, inner side walls and a generally horizontal underwall connecting the inner walls to form an air tunnel, the inner side walls tapering inwardly from the bow to the stern of the hull structure to compact the air passing through the tunnel to lift the hull in operation. The sponsons also have outer, generally vertical, extending outer side walls to form a deadrise sufficient to maintain the hull structure in the water during operation, and a connecting under surface between the inner and outer walls, with a plurality of strakes extending from the connecting under surface and generally extending substantially between the bow and stern to provide a smooth, stable ride of the hull structure through waves in operation. A short, generally flat, horizontal keel on either outward side of the inner walls provides stability to the hull structure during high speed operation.

15 Claims, 5 Drawing Sheets

HIGH SPEED CATAMARAN HULL AND BOAT

BACKGROUND OF THE INVENTION

Motor powered twin sponson or catamaran type boats are known for high speed and are often referred to as "cigarette boats" due to their slim design and high speed. "Cigarette boats", known for speed, were designed by Don Aronow, a well known boat designer, and such boats include a central tunnel between the sponsons to permit the flow of air therethrough and a sharp, pointed, tapered bow for aerodynamic purposes, and include strakes on either side for stability.

It is desirable to provide a new and improved catamaran type hull structure and boat with the hull structure to provide improved control, speed, stability, efficiency and operation.

SUMMARY OF THE INVENTION

The invention concerns a high speed, efficient hull structure and a motor powered boat employing the hull structure. In particular, the invention relates to a boat hull with twin sponsons having multiple inner and outer strakes to provide for improved stability and maneuvering through waves, an increased deadrise on the outer edge of the sponsons and a tunnel between the sponsons with a wedge on the undersurface thereof to provide for lift and improved aerodynamic qualities during operation.

The invention comprises a high speed, high efficiency catamaran boat hull and boat containing the hull, which hull comprises a boat hull structure having an under surface, a curved bow and a generally flat stern, a pair of spaced-apart sponsons on either side of the keel line of the hull and extending generally substantially from the bow of the hull, wherein the sponsons generally come to a point, to the stern of the hull, the sponsons having generally vertical, downwardly extending, inner side walls and a generally horizontal under wall connecting the inner side walls to form an air tunnel. The inner side walls taper inwardly from the bow to the stern of the hull structure to compact the air passing through the tunnel to lift the hull in operation, the sponsons having outer, generally vertical, extending outer side walls to form a deadrise sufficient to maintain an increased amount of the hull structure in the water during operation. A connecting undersurface between the inner and outer walls with a plurality of strakes extending from the connecting undersurface and generally extending substantially between the bow and stern provide a smooth, stable ride of the hull structure through waves in operation, and a short, generally fiat, horizontal keel on either outward side of the inner walls which flat section tapers inwardly beyond the middle of the hull to provide stability to the hull structure during high speed operation and maneuvering.

Optionally and preferably, the outer side walls are generally slightly, concavely, curved at the upper portion to promote a smoother passage of the hull structure through waves. The hull includes a generally V-shaped wedge means extending downwardly from the under wall to promote the lifting of the hull structure over waves, the wedge means generally centrally positioned on the horizontal under wall and extends from about the stern to the mid line of the hull structure. The tunnel formed by the outer side walls has a bow inlet and a stern outlet, with the inlet up to six inches in width greater than that of the outlet.

The hull may optionally include a hull beam of greater than about ten feet and include a notch in at least one of the strakes on either side of the hull structure to break up wave buildup in operation. The hull includes at least two or three uniformly spaced apart strakes on either side of the under surface and each strake includes a short, horizontal, fiat section on the inward side of each strake. The hull generally tapers inwardly beyond the mid line of the hull.

The keel means of the hull, in one embodiment, includes two short, generally vertical, downwardly extending keel sides and a flat, horizontal connecting surface between the keel sides. The hull includes a transom adapted to receive and install motors at the stern of the hull structure to drive the boat. Usually and preferably, the hull includes a hull beam of greater than about ten feet.

The invention comprises a motor powered catamaran boat having the hull structures set forth and including a top surface with a cockpit for one or more operators of the boat, for example, an aerodynamically arcuate cockpit cover for the occupants. The boat may include toward the bow on the top surface, a pair of stabilizing fins on either side, and an aerodynamic stabilizing fin between and forward of the pair of side stabilizing fins, the fins adapted to move by hydraulic or other moving means between a position generally aligned with the plane of the top surface and an outwardly extended position, and a plurality of positions therebetween to stabilize the boat during high speed operation.

The hull and boat incorporates a wide body, deep catamaran hull, which provides superior stability and handling characteristics at all speed and sea conditions in comparison to other speed performance alternatives. The hull design enables the use of "off the shelf" outboard power packages resulting in a cost effective, low maintenance, highly reliable operating platform. The smooth ride has added benefits of reduced operator fatigue and less equipment wear and tear. Most competitive catamaran boats in this size range are narrower in beam (8"0" to 8'6") with a shallower deadrise (18°) than the boat of the invention. As a result, they run on top of the water, resulting in poor turning and handling characteristics, and limited high speed capability in rough sea conditions. Additionally, air flow through the tunnel is "vented" erratically leading to boat instability. By contrast, the hull and boat of the invention has a full beam 24 ° deadrise hull, featuring multiple lifting strakes and a unique keel step pad. The step pads and sharp deadrise combination allow the hull to remain in contact with the water while maneuvering, maintaining operator control at all times even in rough sea conditions.

The hull's multiple lifting strakes lift the boat sufficiently to allow quick and smooth air flow through the tunnel. This creates less drag and higher speeds with less horsepower and thus, efficient fuel usage and greater range.

The hull and boat of the invention is designed and provides for a high speed, efficient boat having a smooth ride, improved stability, for example, at 80–100 mph, in wave conditions and in sharp turns. The boat, powered by motors, can be operated at extremely high speed and the tunnel design compacts the air flow to lift the rear of the boat during high speed operation, while the two keels also aid in lifting the stern of the boat like a ski effect at high speed, without loss of control or stability.

The invention will be described for the purposes of illustration only in connection with certain embodiments; however, it is recognized that those persons skilled in the art may make various modifications, additions, changes, variations and improvements to the illustrated embodiments without departing from the spirit and scope of the invention.

DESCRIPTION OF THE EMBODIMENTS

Figure 1:
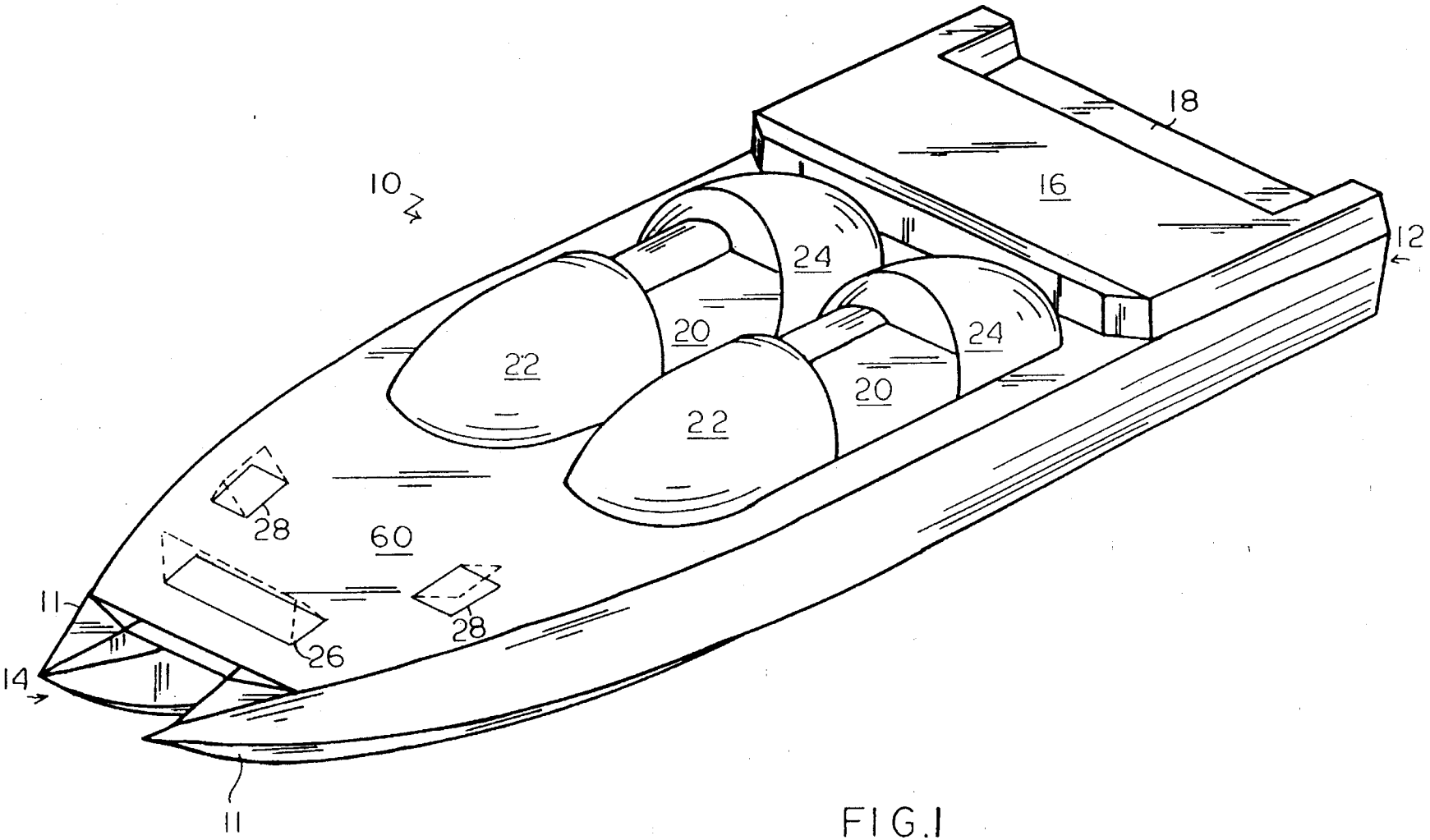
FIG. 1 is a perspective view from above of a "cigarette" type catamaran boat of the invention.

As shown in the drawings, FIG. 1 illustrates high speed catamaran boat with the hull structure of the invention 10 with a wide body and deep catamaran hull having twin sponsons 11 and a sharp, pointed, tapered bow 14 for aerodynamic purposes, and a generally flat stern 18 with space for outboard power motors 58. The top surface of the boat may have a variety of top surface configurations; however, in one preferred embodiment as shown, has a smooth, planar, upper surface 60 with a rear transom 16, motor mount section 18, and dual cockpits 20 with aerodynamically designed, transparent cockpit covers with a curved, tapered front 22 and curved, tapered back 24 to provide for less wind resistance in operation and maneuvering. A pair of stabilizing fins 28 are located on either side and toward the bow on the top surface, and a further stabilizing fin 26, located between the two side fins and further toward the bow, are adapted to move between a position aligned with the plane of the top surface and an outwardly extended position during operation, and function in a similar manner to flaps on a airplane, providing increased stability at high speed maneuvering on the water.

Figure 2:
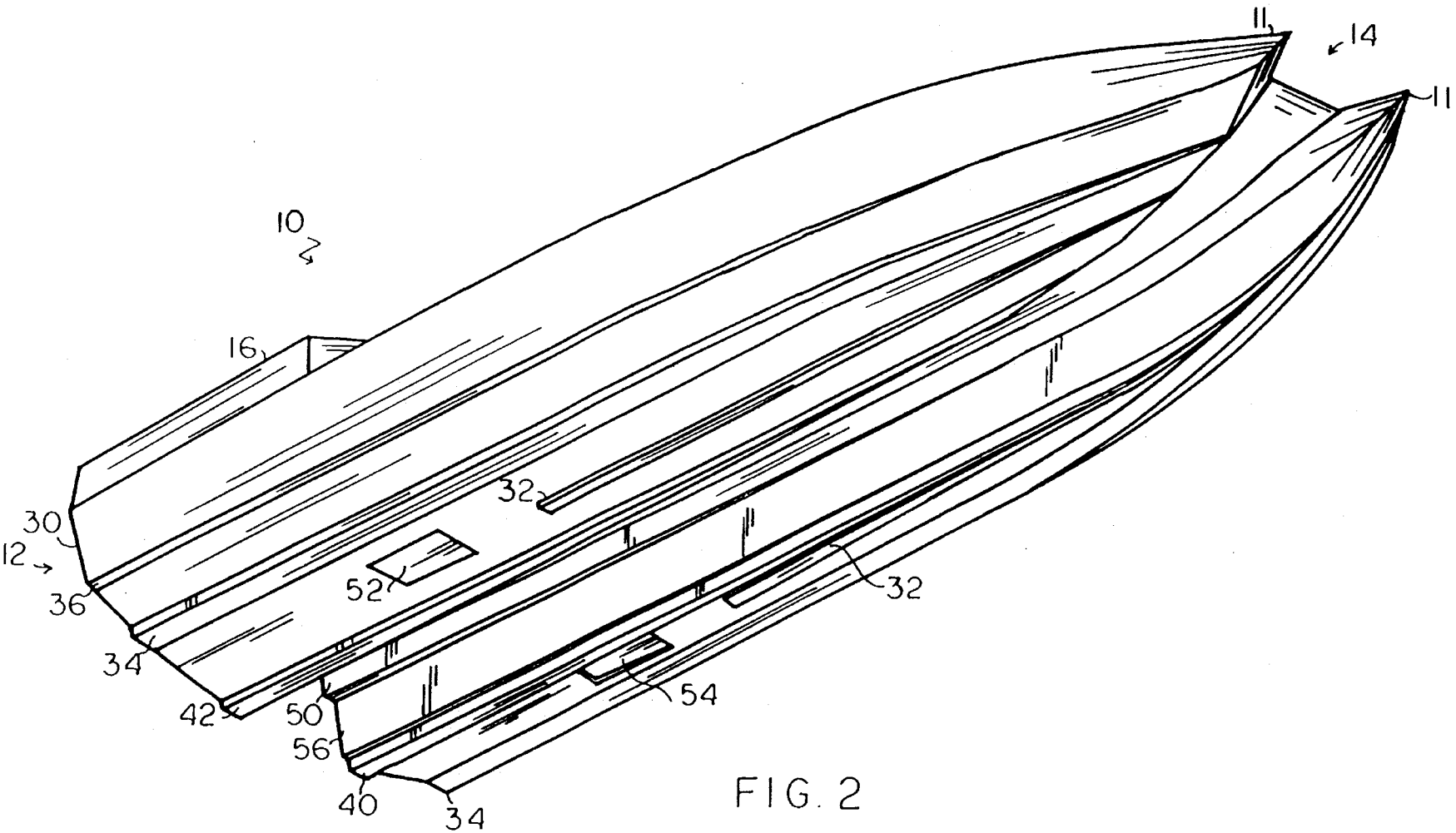
FIG. 2 is a perspective view from below of the front of the hull structure of the boat of FIG. 1.
Figure 3:
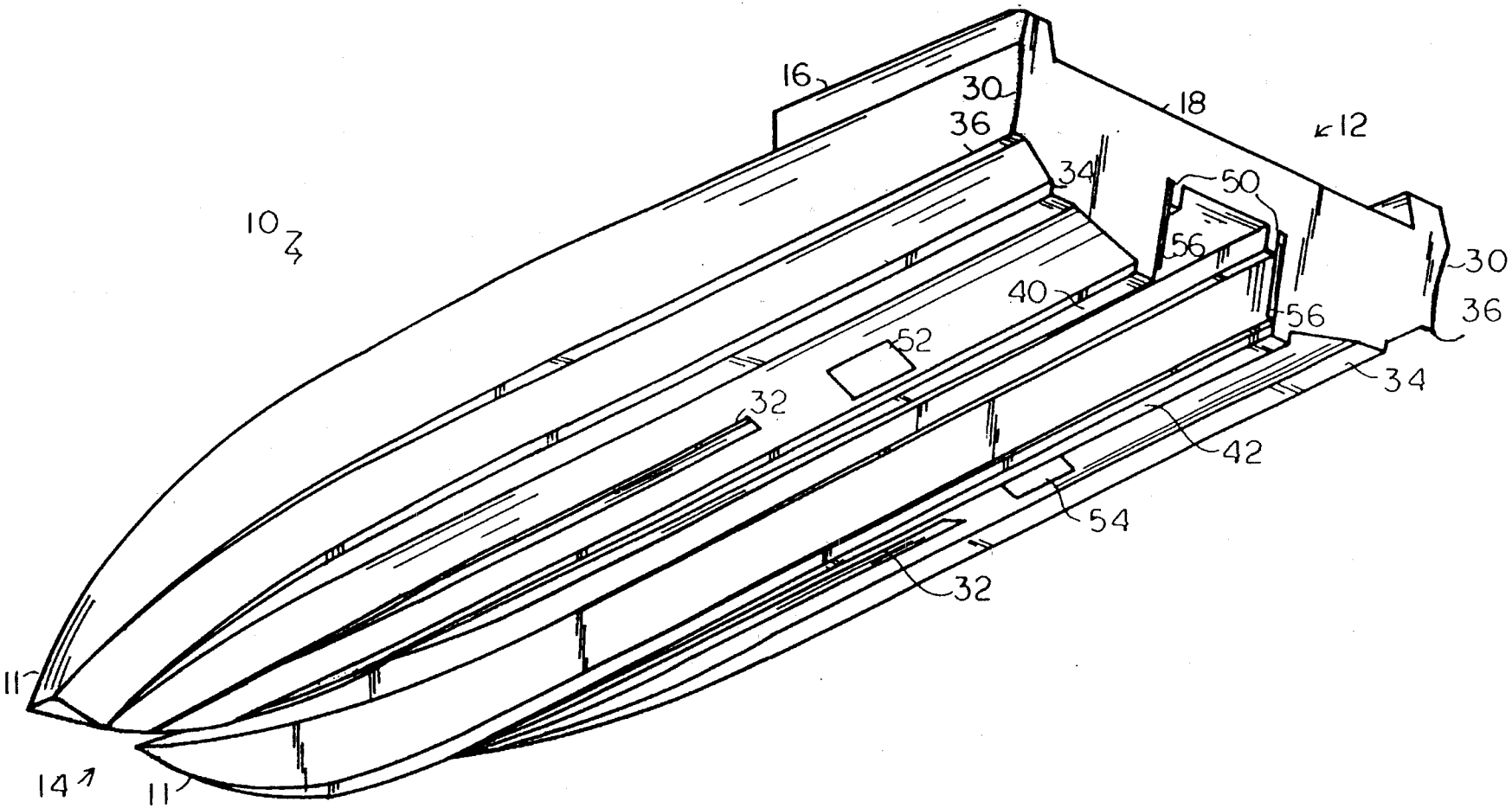
FIG. 3 is a perspective view from below of the rear of the hull structure of the boat of FIG. 1.

FIGS. 2 and 3 show the undersurface of the boat hull of the invention 10, with the tapered bow 14 and the flat stern 12. A plurality of tapered inner, 50 and 56, and outer 32, 34, and 36, lifting strakes located on the spaced-apart twin sponsons 11 provide for lift of the boat hull out of the water to allow for increased speed due to the enhanced air flow through the central tunnel 38. Tunnel inlet 46 is generally larger in width, up to 6 inches, than tunnel outlet 38, thus providing for compaction of air passing through the tunnel to further lift the hull in operation. The twin sponsons 11 have outer, generally vertical, slightly concavely curved, extending side walls 30 to form a deadrise sufficient to maintain an increased amount of the hull structure in the water during operation, to provide increased stability. The hull may optionally include and is shown in these drawings with notches 52 and 54 in at least one of the strakes on either side of the hull structure to break up wave buildup during operation. The two short, generally vertical, downwardly extending twin keels 40 and 42 provide increased stability on turns and in rough wave conditions. The hull also includes a generally V-shaped wedge 44 extending downwardly from the under wall to promote the lifting of the hull structure over waves, creating less drag at higher speed with less horsepower and thus, efficient fuel usage and greater range.

Figure 4:
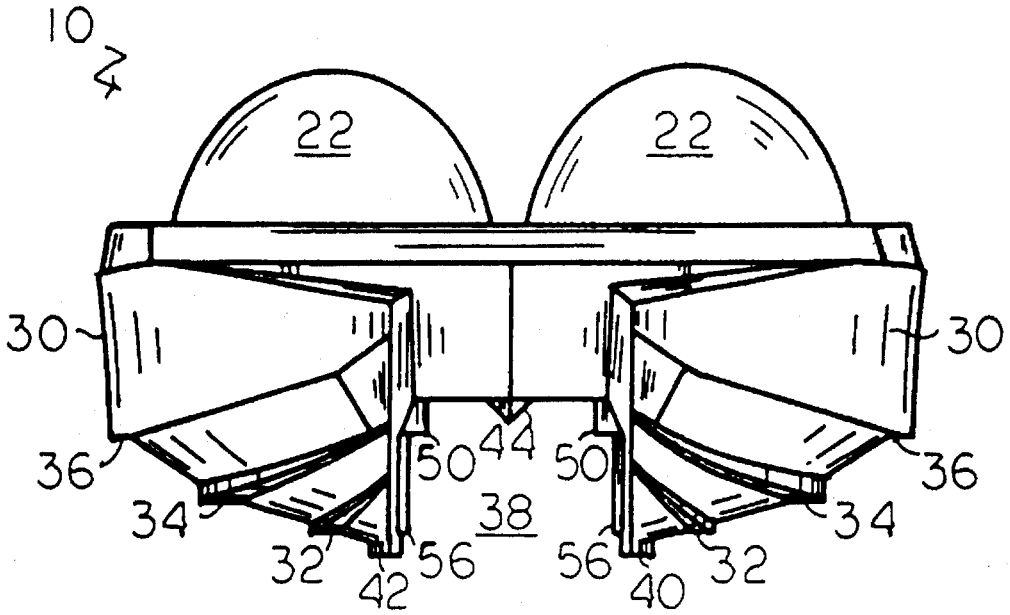
FIG. 4 is a front plan view of the boat of FIG. 1.

FIG. 4 illustrates the catamaran boat hull of the invention 10 in a front elevational view, further illustrating the inner and outer strakes 32, 34, 36, 50, and 56, which provide a smoother, more stable ride of the hull structure in the water during operation, the slightly concavely curved sides 30, to promote a smoother, more stable ride with less resistance through waves in operation, the lifting wedge means 44 inside the tunnel 38 to further provide compaction of air and lift of the hull in the water, the tapered bow 14, and the front dual transparent, aerodynamic, cockpit covers 22.

Figure 5:
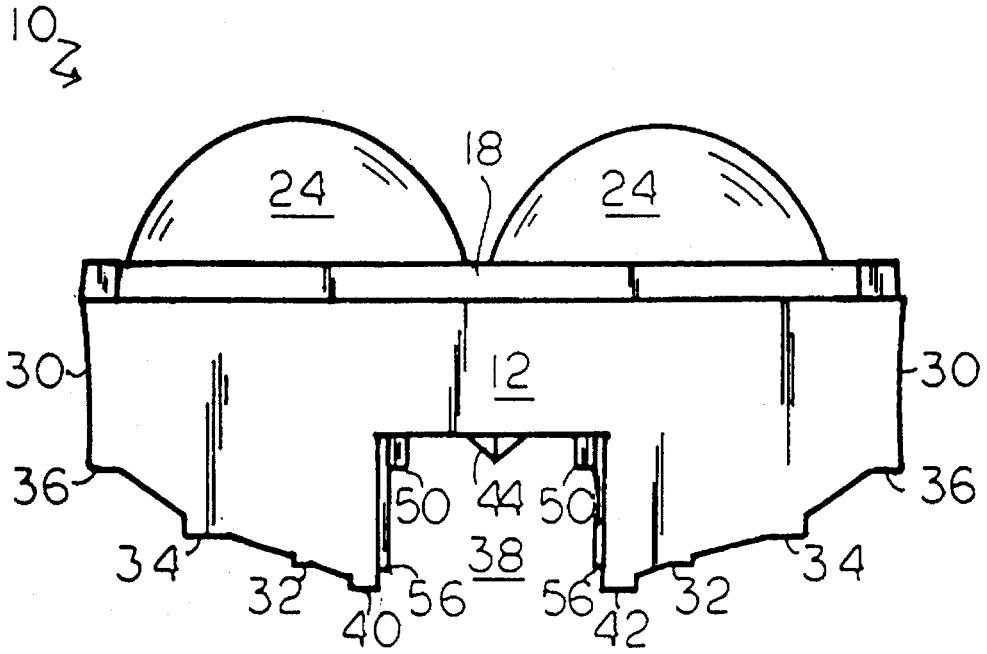
FIG. 5 is a back plan view of the boat of FIG. 1.

FIG. 5 shows a rear view of the boat hull of the invention 10, with the motor mount section 18, the rear dual transparent aerodynamic cockpit covers 24, the slightly concave side walls 30, the lifting wedge 44 within the tunnel 38, and the multiple strakes 32, 34, 36, 50 and 56, with the twin keels 40 and 42 for stability.

Figure 6:
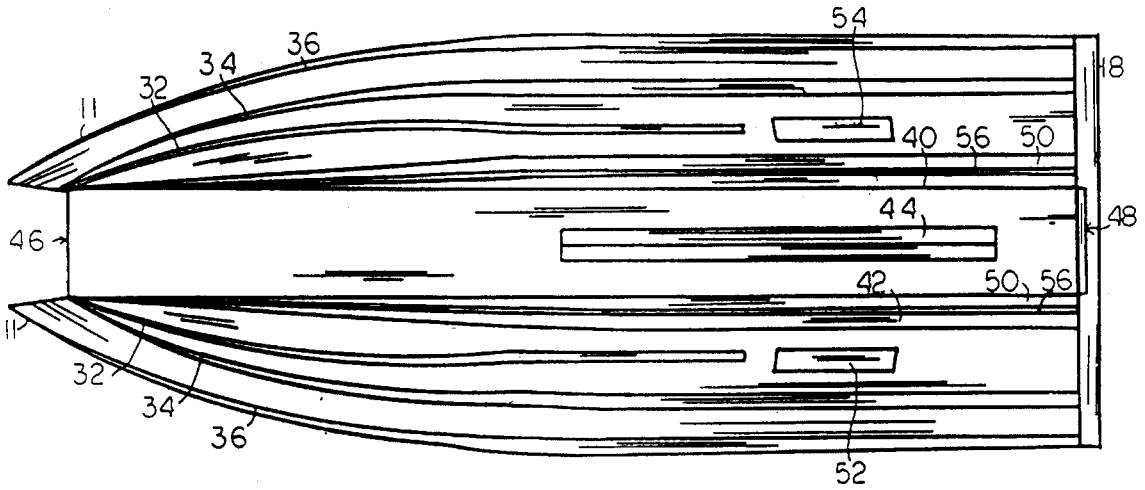
FIG. 6 is a bottom plan view of the boat of FIG. 1.

FIG. 6 illustrates a bottom plan view of the boat hull of the invention 10, with motor mount section 18, tunnel inlet 46 and tunnel outlet 48 for the passage and compaction of air through the tunnel 38 channeled by the wedge 44, tapering twin keels 40 and 42, and inner and outer lifting strakes 30, 32, 34, 50 and 56, which provide for smoother passage of the hull through waves. FIG. 6 further shows the notches 52 and 54 located in the strakes on either side of the hull structure to break up wave buildup in operation.

Figure 7:
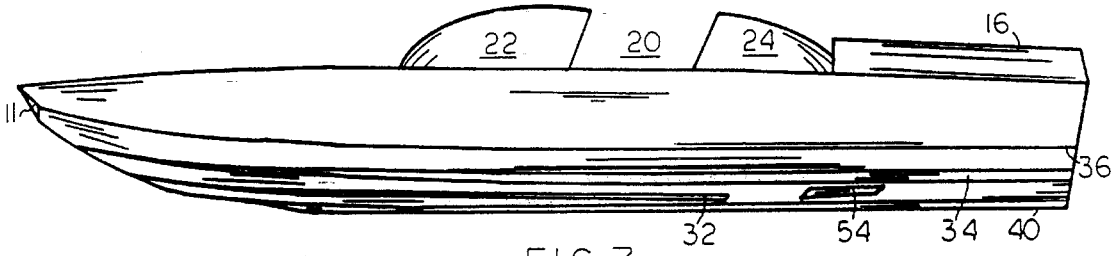
FIG. 7 is a side plan view of the boat of FIG. 1.

FIG. 7 illustrates the boat hull of the invention 10 from a side elevational view, with the cockpit 20 having the dual, transparent, aerodynamic cockpit covers 22 and 24, multiple outer strakes 32, 34 and 36, notch 52, and keel 40, with top surface 60 having transom 16 and motor mount area 18.

Figure 8:
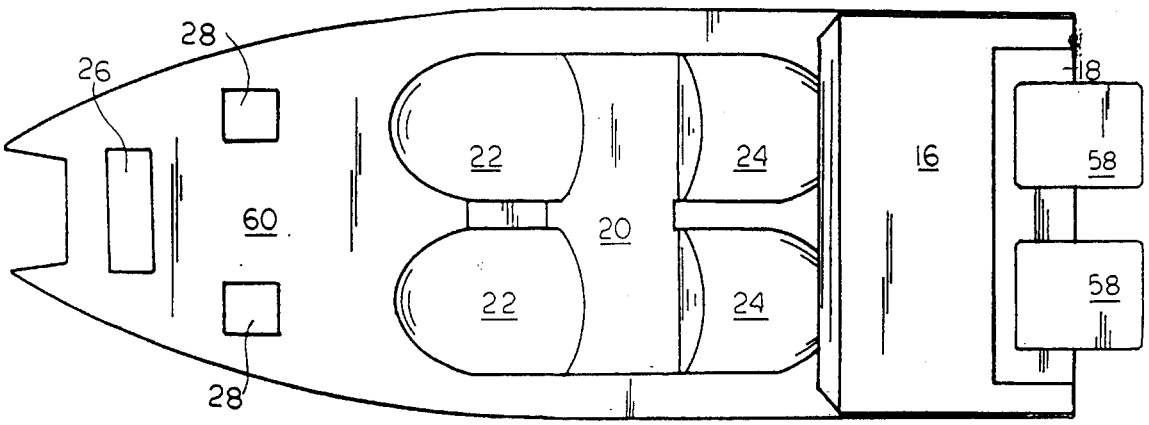
FIG. 8 is a top plan view of the boat of FIG. 1 with twin motors secured to the transom.

FIG. 8 illustrates a top view of the boat hull of the invention 10, with motors 58 mounted on to motor mount 18, transom 16 and upper surface 60 with stabilizing fins 26 and 28 located toward the bow. Cockpit 20 has front 22 and rear 24 curved, transparent, cockpit covers to provide for improved aerodynamic performance and increased speed of the boat on the surface of the water. As the boat hull of the invention is designed for extremely high speeds, up to 100 mph, the cockpit covers also provide protection and increased comfort for the operators of the boat.

As shown and described, the hull and boat of the invention is designed and provides for high speed, increased maneuverability, and more stability in a variety of water and operational conditions. The hull of the invention, with a wider beam than prior art catamaran boat designs, an increased deadrise, concavely curved side walls, multiple lifting strakes, and unique keel step pad provide for new, significantly improved and unexpected results in allowing the hull to remain in contact with the water at all times during operation, thus maintaining operator control at all times even at extremely high speeds and/or rough sea conditions. The air tunnel space on the undersurface of the hull further provides for less water resistance and more effective air flow and compaction due to the wedge means and tapering of the tunnel. These features allow for increased speed and less water resistance, providing more fuel efficiency at higher speeds with less horsepower, allowing for the boat of the invention to exercise greater range on the water and spend less time and cost on refueling.

Thus, the high speed catamaran boat hull of the invention provides a high speed, high efficiency, a boat having increased control, a smooth ride and improved stability at speeds of up to 100 mph, in a variety of wave conditions and in sharp turns. Further, the boat hull of the invention provides for increased fuel efficiency and cost-effective operation due to its hydro- and aerodynamic features, which allows for the ability to spend longer time periods on the water as needed.

What is claimed is:

1. A high speed, high efficiency, stable catamaran boat hull which comprises:

a) a boat hull structure having an under surface, a curved bow and a generally flat stern;

b) a pair of transversely spaced-apart, longitudinal sponsons, equally positioned on either side of the keel line of the hull and extending generally substantially from the bow of the hull, wherein the sponsons generally come to a point, to the stern of the hull;

c) the sponsons having generally vertical, downwardly extending, inner side walls having upper and lower ends and a generally horizontal under wall connecting the upper ends of the inner side walls to form a bow inlet and a stern outlet and an open air tunnel therebetween, the width of the bow inlet greater than the bow outlet;

d) the inner side walls tapering inwardly from the bow to the stern of the hull structure to compact the air passing through the air tunnel to lift the rear of the hull structure in operation;

e) the hull having outer, generally vertical, outer side walls having upper and lower ends to form a dead rise sufficient to maintain the hull structure in the water during operation and an inwardly, downwardly angular connecting under surface extending from the lower end of the outer side wall to the lower end of the inner side wall;

f) at least a pair of transversely, spaced-apart, longitudinal outer-extending strakes extending from and on either side of the connecting under surface and generally extending substantially between the bow and stern, the strakes having a generally horizontal flat under surface, to provide a smooth, stable ride of the hull structure through waves in operation;

g) keel pad means comprising a pair of horizontal, downwardly extending short width surfaces, one each on either side of the lower end of the inner side walls, to remain in the water during operation to provide stability to the hull structure during high speed operation, one vertical side of the keel means being an extension of the generally vertical inner side walls; and h) an elongated wedge means having a short, downward V-shape positioned downwardly from and generally centrally on the horizontal under wall and longitudinally extending from about the midline of the hull structure to the stern, to promote the lifting by air in the air tunnel of the hull structure.

2. The hull of claim 1 wherein the inner walls taper gradually from the inlet to the outlet, and the bow inlet has a width of up to six inches greater than that of the stern outlet.

3. The hull of claim 1 wherein the outer side walls are slightly concave to promote a smooth passage of the hull structure.

4. The hull of claim 1 which includes notch means in at least one of the outer strakes on either side of the hull structure to break up wave buildup.

5. The hull of claim 1 wherein the outer strakes consist of two spaced-apart strakes on either side of the under surface and each strake includes a short flat horizontal section and a short downward vertical section on the outward side of each strake.

6. The hull of claim 1 wherein the horizontal surface of the keel pad means is flat and tapers inwardly toward the under surface of the hull and extends beyond the midline of the hull.

7. The hull of claim 1 wherein the keel means includes two short, generally vertical, downwardly extending keel sides and a flat, horizontal connecting surface between the keel sides.

8. The hull of claim 1 which includes a hull beam of greater than about ten feet in width.

9. A boat which includes the hull of claim 1 and which includes at least one aerodynamically arcuate covered cockpit cover for the occupants.

10. The hull of claim 1 which includes, toward the bow on the top surface, a pair of stabilizing fins on either side, the fins adapted to be placed between a position generally aligned with the plane of the top surface and an outwardly extended position, and a plurality of positions therebetween to stabilize the boat during high speed operation.

11. The hull of claim 1 which includes, toward the bow on the top surface, an aerodynamic stabilizing fin between and forward of the pair of stabilizing fins, the fin adapted to be placed between a position aligned with the plane of the top surface and an outwardly extended position, and a plurality of positions therebetween to stabilize the boat during high speed operation.

12. The hull of claim 1 which includes a pair of inner strakes extending longitudinally from the stern toward the bow, each inner strake positioned within the air tunnel at about the intersection of the horizontal under wall and the upper end of the inner side walls.

13. The hull of claim 1 wherein the outer extending strakes include a pair of first outer strakes each with a generally flat, horizontal surface on either side and generally at the lower edge of the outer side wall and a pair of second outer strakes each with generally flat, horizontal surfaces and generally intermediate the angular connecting under surface.

14. The hull of claim 13 which includes a third strake with an outwardly extending short flat surface from the connecting under surface and between the keel means and the second strake.

15. A high speed, high efficiency, stable catamaran boat hull which comprises:

a) a boat hull structure having an under surface, a curved bow and a generally flat stern and having a hull beam greater than about ten feet;

b) a pair of transversely spaced-apart, longitudinal sponsons, equally positioned on either side of the keel line of the hull and extending generally substantially from the bow of the hull, wherein the sponsons generally come to a point, to the stern of the hull;

c) the sponsons having generally vertical, downwardly extending, inner side walls having upper and lower ends and a generally horizontal under wall connecting the inner walls to form a bow inlet and a stern outlet and an open air tunnel therebetween, the bow inlet up to about six inches in width greater than the bow outlet;

d) the inner side walls tapering inwardly from the bow to the stern of the hull structure to compact the air passing through the air tunnel to lift the rear of the hull structure in operation;

e) the hull having outer, generally vertical, slightly concave outer side walls, to form a dead rise sufficient to maintain the hull structure in the water during operation, and a connecting under surface between the inner and outer walls;

f) at least a pair of first and second transversely, spaced-apart, longitudinal outer-extending strakes extending from and on either side of the connecting under surface and generally extending substantially between the bow and stern, the first strake positioned at the lower edge of the outer side wall and the second strake generally intermediate the angular connecting under surface, the strakes having a generally horizontal flat under surface to provide a smooth, stable ride of the hull structure through waves in operation;

g) notch means in the second strakes;

h) keel pad means comprising a pair of horizontal, downwardly extending short width surfaces one each on either side of the lower edge of the inner side wall to remain in the water during operation to provide stability to the hull structure during high speed operation; and i) an elongated wedge means having a short downwardly V-shape positioned on the horizontal under wall to promote the lifting by air in the air tunnel of the hull structure.

* * * * *